United States Patent [19]

Somraty

[11] 4,142,487

[45] Mar. 6, 1979

[54] TWO-STROKE PISTON ENGINE

[76] Inventor: Tomas P. Somraty, 111 Cleeland Rd., No. 132, Pleasant Hill, Calif. 94523

[21] Appl. No.: 792,212

[22] Filed: Apr. 29, 1977

[51] Int. Cl.[2] ..... F02B 33/04

[52] U.S. Cl. ..... 123/73 B; 123/73 V; 123/196 CP

[58] Field of Search ..... 123/73 R, 73 AD, 73 B, 123/73 BA, 73 V, 179 G, 179 CP

[56] References Cited

U.S. PATENT DOCUMENTS

| | | | |
|---|---|---|---|
| Re. 24,792 | 3/1960 | Dalrymple | 123/196 CP |
| 926,892 | 7/1909 | Peterson et al. | 123/73 B |
| 1,022,664 | 4/1912 | Ellu | 123/73 B |
| 1,092,042 | 3/1914 | Hager | 123/73 B |
| 1,296,214 | 3/1919 | Peter | 123/73 B |
| 1,385,250 | 7/1921 | Gerhandt | 123/196 CP |
| 1,483,619 | 2/1924 | Smith | 123/73 B |
| 2,682,259 | 6/1954 | Watkins | 123/196 CP |
| 2,952,252 | 9/1960 | Geatty | 123/196 CP |
| 3,931,812 | 1/1976 | Ashfield et al. | 123/73 R |

*Primary Examiner*—Charles J. Myhre
*Assistant Examiner*—David D. Reynolds
*Attorney, Agent, or Firm*—Owen, Wickersham & Erickson

[57] ABSTRACT

A two-stroke piston engine and method in which oil-free air is mixed prior to ignition with oil-free fuel, by means of a venturi. The engine is lubricated by utilizing the pressure which the piston exerts in the crankcase to draw an air-oil mix into the crankcase and then to push the air and oil out while filtering the air with a rotary filter, to return the oil to a suitable reservoir, the oil-free air being sent to the venturi. Fuel enrichment, as for cold starting, is caused by placing air pressure on a fuel-containing bowl ahead of the venturi so as to increase the flow of fuel into the venturi, rather than by reducing the amount of air as is done with a conventional choke plate.

12 Claims, 8 Drawing Figures

FIG.4
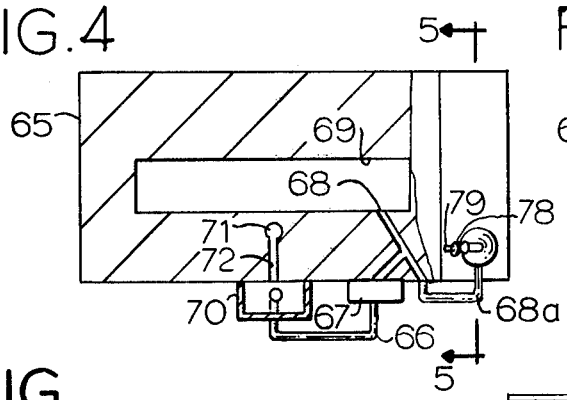
FIG.5
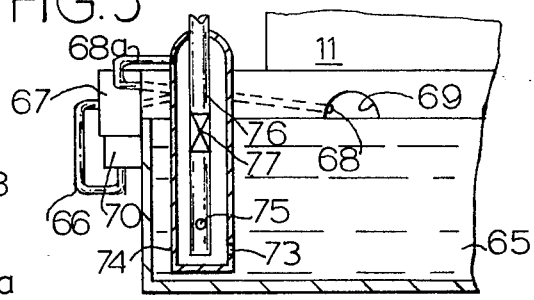
FIG. 6
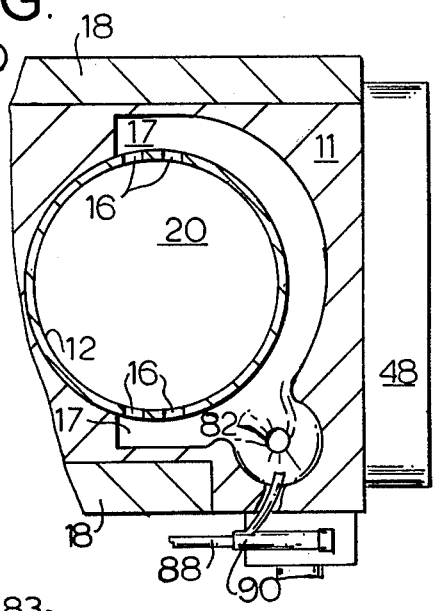
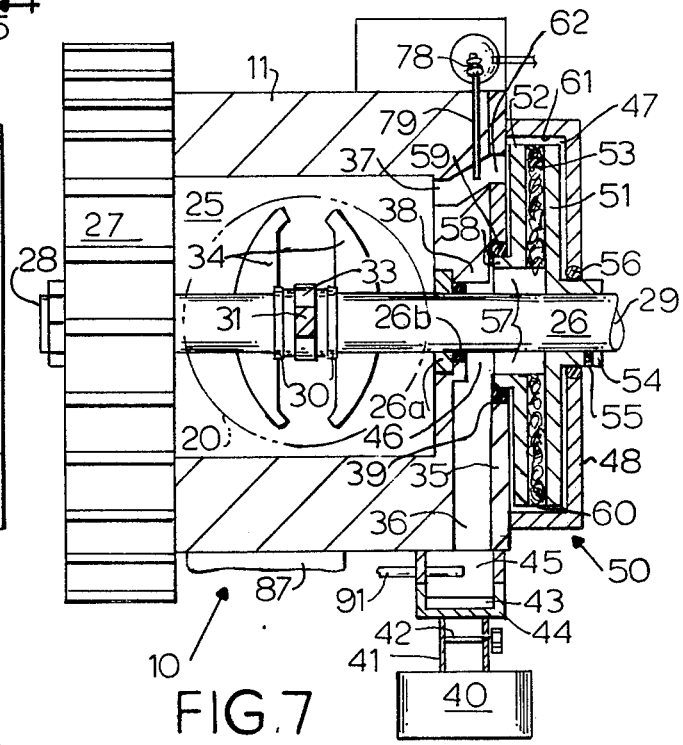
FIG.7
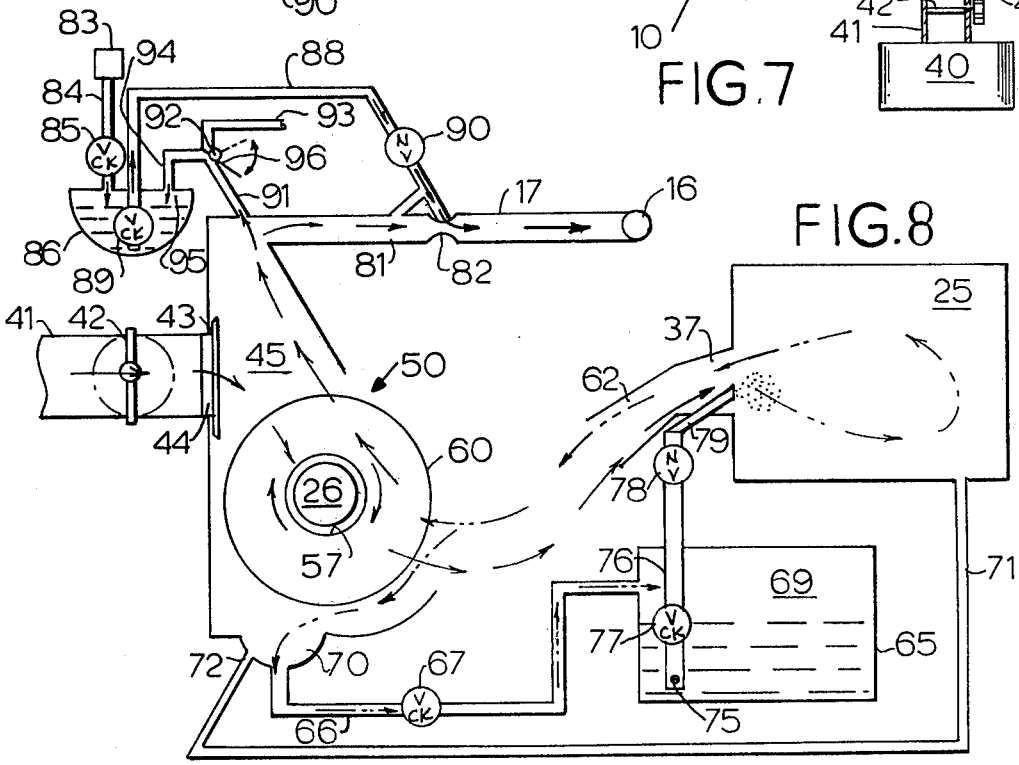
FIG.8

TWO-STROKE PISTON ENGINE

BACKGROUND OF THE INVENTION

This invention relates to an improved two-stroke piston engine and to an improved internal combustion method.

Current conventional two-stroke engines mix the fuel with a substantial proportion of lubricant and carburet the fuel-oil mixture and air before sending the air-fuel-oil mixture to a venturi. To be more specific, air is usually moved by atmospheric pressure past a choke plate and through the venturi, where fuel and oil are induced into the air stream; then this mixture of air, fuel, and oil is sent around a throttle plate, past reed check valves, and into the crankcase, from which the mixture is taken into the cylinder when the piston approaches its limit of travel farthest from the cylinder head. The purpose of this procedure, aside from refueling the cylinder, is to provide the needed lubrication of parts in the crankcase and of the parts of the cylinder and piston that come into contact with each other. However, as a result of this procedure a substantial amount of lubricant is consumed by the engine during operation and is expelled with the exhaust gases. In fact, the main objection usually raised about such two-stroke engines is the large amount of expensive lubricating oil used by these engines, necessitating the inconvenience of mixing the fuel with oil and leading to harmful pollution of the environment.

I have found that by providing an engine operating according to a completely different procedure, I can reduce the consumption of lubricating oil to an amount like that consumed in four-cycle engines. At the same time, I can improve the operation of the engine.

Thus, an important object of this invention is to provide a two-stroke piston engine which is more economical to operate than previous two-stroke piston engines.

A further important object of the invention is to provide a two-stroke piston engine in which very little lubricant is consumed during operation.

Another object of the invention is to provide a two-stroke piston engine that is less polluting in its operation and can meet higher standards set by environmental protection agencies.

Another object is to provide a two-stroke piston engine having lower manufacturing costs than heretofore.

Another object is to provide a two-stroke piston engine that is competitive economically with four-stroke piston engines, for many uses.

A further object is to provide an improved method of operation for a two-cycle engine.

SUMMARY OF THE INVENTION

A two-stroke engine of this invention has a cylinder with a head, an open end, one or more intake ports, and one or more exhaust ports generally closer to the head than the intake port or ports. A compact crankcase lies adjacent to and opens into the open end of the cylinder. A rotatable shaft in (and extending outside) the crankcase has a flywheel on one end outside the crankcase, a power output on the other end outside the crankcase, and a crank in the crankcase. A connecting rod joins the crank to a piston in the cylinder, and the crank has a throw greater, and the piston a stroke greater, than the distance between two of the piston's oil-sealing and compression rings. Moreover, the piston rings most distant from the cylinder head never move across the intake ports or exhaust ports. The volume of the crankcase is kept small, so that the piston will have a significant pressure effect on air within the crankcase.

An intake manifold enclosing the intake port or ports has a venturi at its entry. A fuel system has a fuel intake line, a bowl normally exposed to atmospheric pressure, and a fuel supply line having a check valve therein leading from the bowl to the venturi.

An air inlet is provided with an air cleaner, a throttle plate, and reed check valves to admit air into the crankcase when the piston is moving toward the cylinder head and thereby reducing the pressure in the crankcase. Below the crankcase, but not open to it, is an oil reservoir having a metering valve for metering oil into the incoming airstream as it flows into the crankcase. The metered oil is mixed with the air, preferably by atomizing it into the air, and is carried into the crankcase and from there, into the adjacent portion of the cylinder, so that it lubricates between the cylinder and the piston, as well as lubricating other moving parts. When the piston moves away from the cylinder head, the crankcase pressure forces air-oil mist out from the crankcase, and at the same time the pressure in and from the crankcase closes the reed check valves at the air inlet.

The air-oil mist leaving the crankcase is forced to pass through a filter that removes the oil for return to the reservoir. The filtered air is oil-free. Oil is returned to the reservoir by a drainage line in the bottom of the crankcase and a line from the filter's cover.

The filtration is preferably accomplished by a rotary filter mounted on the crankshaft near the boundary of the crankcase. The filter operates centrifugally and also contains a filter medium for aiding in separating the oil from the air. The filter's inlet for the oil-air mixture preferably lies all around its outer periphery, and its outlet for the oil-free air is at its inner periphery. The crankcase is kept small in volume, being reduced in volume enough to compensate for the volume of the filter and adjacent areas, so that there is adequate pressure variation in the crankcase and filter as the piston reciprocates. The oil-return conduit includes a check valve passing air into the oil reservoir but not out therefrom, so that as the piston moves away from the cylinder head, pressure is built up inside the oil reservir, as it is inside the crankcase. Then, when the piston moves toward the cylinder head, the crankcase pressure drops while the pressure within the oil reservoir remains high. As a result, the pressure within the oil reservoir forces oil through the metering valve and into the air that is then being drawn into the crankcase.

The filtered oil-free air is sent through the venturi, drawing in and mixing with the oil-free fuel from the fuel supply line. As a result, a mixture of oil-free fuel and oil-free air flows to each intake port at the time the piston opens the intake ports. Hence, there is very little consumption of lubricant, for the lubricant is used only to lubricate within the crankcase.

A fuel enrichment system accomplishes what is, in other engines, accomplished by a choke. For this purpose, there is a check valve in the fuel intake line, and a branch air conduit conducts some of the oil-free air on its way to the venturi, into an air space directly above the surface of the liquid in the fuel bowl. This branch air conduit has a normally closed valve, which can be opened manually to place air under crankcase pressure above the fuel in the bowl. When the bowl is thus pressurized, more fuel than normal is forced through the fuel supply line to the venturi, enriching the oil-free fuel-air mixture fed to the intake port manifold. When the need for enrichment is over, the normally closed valve in the branch air conduit is closed, and the fuel bowl is returned to its normal operation, exposed to air under atmospheric pressure.

The main similarities between the method of operation of the present two-stroke piston engine and that of conventional ones, are that both use crankcase pressure to recharge the cylinder with a fresh supply of fuel and air, that the supply of the fuel-air mixture passes through intake ports at the lower end of the piston stroke, and that, in both, the compressed gases are fired each time the piston reaches or approaches its upper limit of travel. In most other ways, the present invention operates differently from conventional two-stroke piston engines. Unlike them, the engine of this invention mixes no oil with the gasoline, and the air is handled in a completely different manner, nearly opposite to carburetion systems of current two-stroke piston engines.

In the method of the present invention, the incoming air, at the very beginning, passes around a throttle plate and then through a check valve, such as a reed valve, and from there goes into the crankcase, without mixing with any fuel. However, after passing the reed valves, the air, in an amount selected by the throttle plate, preferably flows through the rotary filter from the center outward and then through a port or ports that enters into the crankcase. As the air enters the crankcase, a small amount of oil is injected into it, creating a mixture to lubricate the crankcase and all of the moving parts therein.

When the piston begins its downward travel, air is then forced to flow back by the same path from which it had entered the crankcase, again passing through the filter but this time, from the outside in. The compression of the air within the crankcase closes the reed valves, and they remain closed until the piston travels downward far enough to open the intake ports in the cylinder wall. Thus, as soon as decompression of the cylinder through the exhaust ports has taken place, the air trapped inside the crankcase is forced via the filter through the intake manifold to the lower pressure area inside the cylinder. To reach the intake manifold, the air leaving the crankcase must first pass through the rotary filter, which removes all of the oil from it, and only then does the air flow toward and through the venturi, which creates a low pressure area in the air stream, so that a metered amount of fuel is drawn in and is mixed with the air without using any carburetor per se.

Thus, whereas a conventional carburetion system blends a mixture of gasoline and oil with air *before* the air *enters* the crankcase, in the present invention unblended fuel without oil is mixed with the air but only after the air has first entered the crankcase, lubricated the engine, and has been filtered free from the oil. Fuel is mixed with the air *after* the air *leaves* the crankcase. This is substantially the opposite of prior-art systems.

The throttle plate, which restricts the amount of air entering the crankcase, also, therefore, restricts the amount of air that passes through the venturi and, in turn, determines the degree of vacuum to be developed in the venturi. Thus, the intake manifold is separate from the crankcase, and yet it is linked to the crankcase by way of the rotary filter which removes the entrained oil.

In the present system, carburetion is accomplished in the venturi itself, but a fuel bowl like that in a conventional carburetor may be used, and in fact a conventional carburetor mechanism may, if desired, be used, having a fuel bowl and float assembly; the venturi draws fuel from the fuel bowl into the air which mixes with the fuel in the venturi (i.e., atmospheric pressure within the bowl forces the fuel into the low pressure area within the venturi), but in this invention no mixture takes place inside such a conventional "carburetor" mechanism.

The method of operation is also novel in its fuel enrichment system, which is different from the typical choke that enriches the fuel-air mixture by reducing the size of the air passage and thereby reduces air flow and draws in more fuel relative to the air. In the present invention, the fuel enrichment used at the time that choking would normally be used, as in starting a cold engine, employs a valve that switches from atmospheric pressure on the fuel in the bowl to crankcase pressure, by inducing air under pressure into the space above the fuel in the bowl. The more highly pressurized fuel bowl then sends more fuel to the venturi to provide a richer mixture with the air. The normally closed valve is open only at times when fuel enrichment is necessary, primarily for starting the cold engine. Once the engine has been started, the fuel enrichment selector is rotated, so that the valve is closed, and atmospheric pressure again operates to pressurize the fuel in the bowl from then on.

To enable this type of operation in which crankcase pressure pressurizes the bowl, it is necessary to have a check valve in the fuel line, so that the fuel can pass from the tank to the bowl, but not back. With this arrangement, crankcase pressure cannot backfeed the fuel toward the tank. Another check valve is also necessary in the fuel line leading from the fuel bowl to a needle valve assembly near the venturi, to stop any flow of fuel from the needle valve back to the fuel bowl and float assembly when the piston is on its downstroke, compressing air in the engine crankcase and manifold system.

It should be stressed that fuel is not mixed with the air until the air has lubricated the crankcase, has left the crankcase, and has been freed of oil content. Only when the air is moved toward the cylinder and after the intake ports are opened by the piston's being displaced below the intake ports, is air mixed with the fuel, and this mixture occurs in the venturi, at the entrance to the intake manifold, rather than in a carburetor per se.

Other objects and advantages of the invention will appear from the following description of a preferred embodiment thereof.

BRIEF DESCRIPTION OF THE DRAWINGS

In the drawings:

FIG. 4 is an horizontal sectional view of the oil reservoir, taken along the line 4—4 in FIGS. 3 and 5, with portions broken away.

FIG. 5 is a view in section taken along the line 5—5 in FIG. 4.

FIG. 6 is a fragmentary view in section taken along the line 6—6 in FIG. 2.

FIG. 7 is a view in section taken along the line 7—7 in FIG. 2. A broken circle indicates the position of the cylinder which lies above the section plane.

FIG. 8 is a very diagrammatic representation of the air-oil-fuel systems.

DESCRIPTION OF A PREFERRED EMBODIMENT

The engine 10: cylinder 12, piston 20, and crankcase 25

Figure 1:
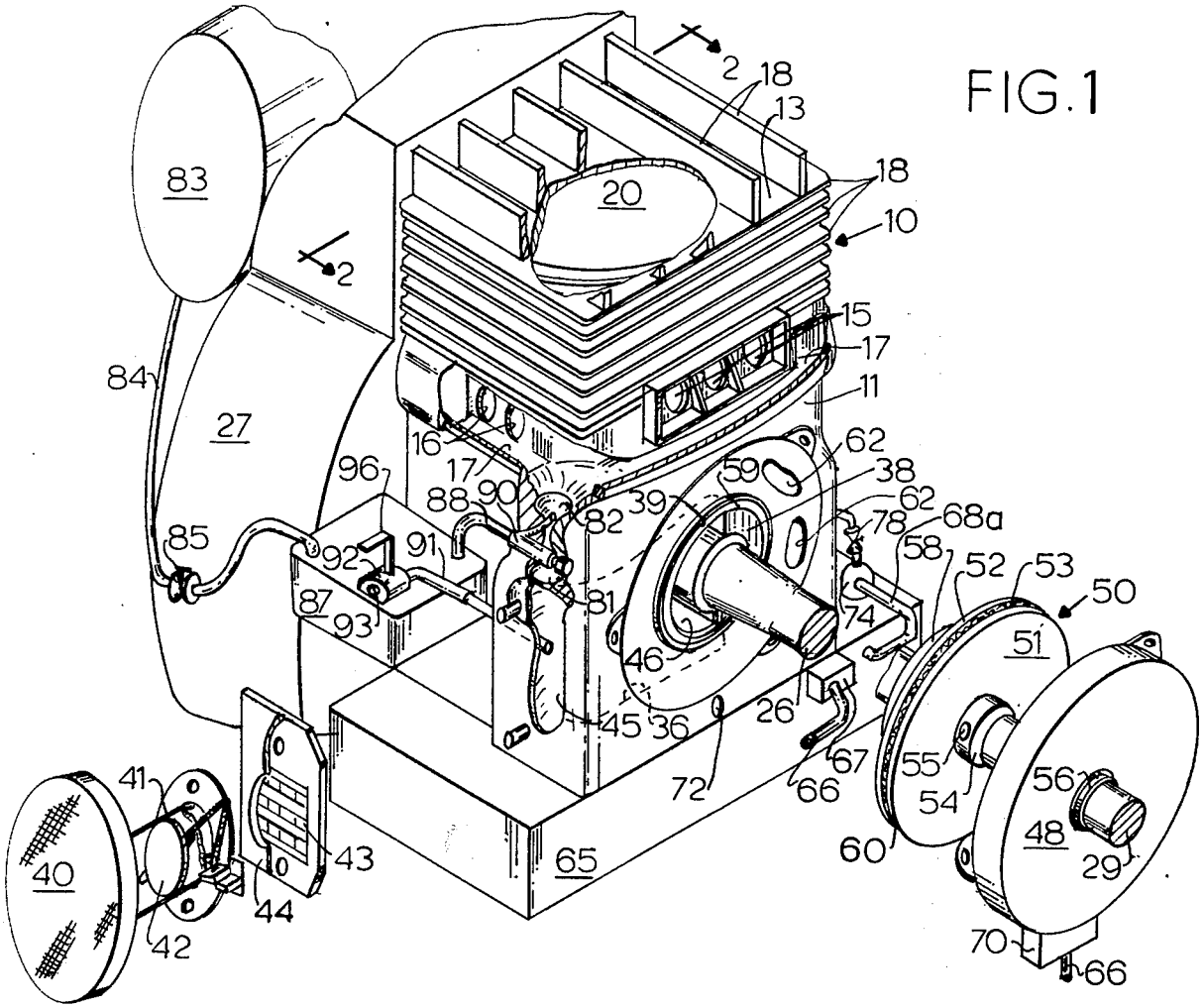
FIG. 1 is an isometric, partially exploded view of an engine embodying the principles of the invention, some parts being broken away to expose others.
Figure 3:
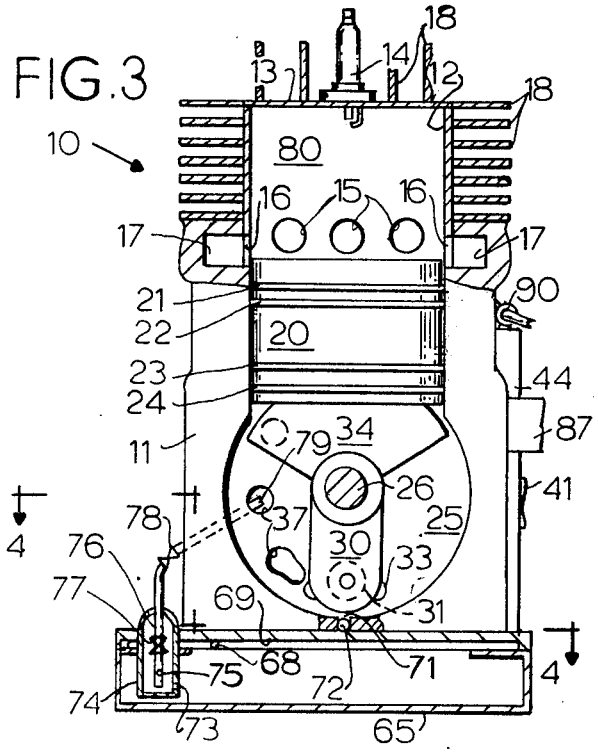
FIG. 3 is a view similar to FIG. 2 with the piston shown at the bottom of its stroke.
Figure 2:
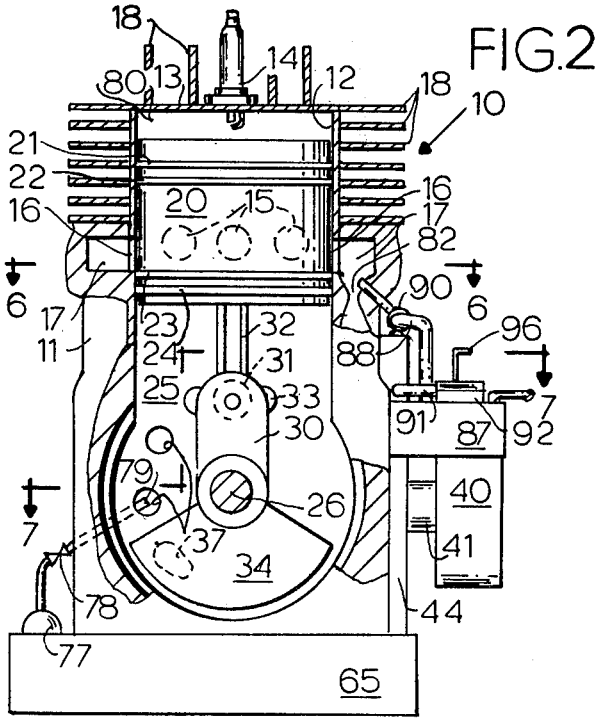
FIG. 2 is a view in section of the engine, taken along the line 2—2 in FIG. 1, with the piston shown at the top of its stroke.

An engine 10, shown partially exploded in FIG. 1 and in section in FIGS. 2, 3, 6, and 7, includes a casing 11 providing a cylinder 12 (FIGS. 2 and 3) having a head 13 at which a spark plug 14 may be located. The cylinder 12 is provided with one or more exhaust ports 15 and one or more intake ports 16, and the intake ports 16 are provided with an intake manifold 17. For an air-cooled engine 10, cooling fins 18 may be provided; a water-cooled engine may use a conventional water-cooling system.

A piston 20 moves in the cylinder 12 and is provided with piston rings, for example, four rings 21, 22, 23, and 24. The extreme piston rings 21 and 24 are relatively close to the ends of the piston 20, and it will be noted from a comparison of FIGS. 2 and 3 that the lower piston rings 23 and 24 never go above the intake ports 16 or the exhaust ports 15. It will also be noticed in the comparison of FIGS. 2 and 3 that at the bottom of the stroke the upper piston rings 21 and 22 both lie below the position occupied by the piston rings 23 and 24 at the top of the stroke. An air-oil mixture is used to lubricate the engine 10 from within a crankcase 25, as a mist. This mist is able to accomplish proper lubrication of the moving parts, including the rings 21, 22, 23, and 24, without sending any of the air-oil mist into or out through any of the ports 15 or 16; yet, full lubrication of all the piston rings 21, 22, 23, and 24 is achieved.

A shaft 26 rotates inside the crankcase 25, being supported on suitable bearings 26*a* (FIG. 7) with oil seals 26*b*. The shaft 26 extends beyond the crankcase 25 at both ends, with a flywheel 27 (FIG. 7) on one end portion 28 and a power take-off arrangement (not shown) on the other end portion 29. Since a one-cylinder engine 10 is being described, by way of example, the shaft 26 carries a single crank 30, supporting a thrown shaft 31 (FIGS. 2, 3, and 7) and a connecting rod 32 (FIG. 2) connects the piston 20 to the thrown shaft 31 by means of suitable bearings 33. The shaft 26 also carries normal counterweights 34. The crankcase 25 is enclosed in the casing 11 with the aid of a closure plate 35, in which are provided conduits 36 and 62 (FIG. 7). As can be seen in FIGS. 1 and 7, a portion 38 of the plate 35 closes off a generally semicircular portion of a circular opening 39 through the casing 11, which has ports 37 therethrough that are connected to the conduits 62.

The air entry and flow into the crankcase 25; the separator 50

Air enters the engine 10 via an air cleaner 40 and a conduit 41 having a throttle plate 42 (FIG. 1), and reed check valves 43 having an air-distributing casing 44 connected to the conduit 41. As best shown in FIGS. 1 and 7 (and diagrammatically in FIG. 8), the air flows from the check valves 43 into a main air conduit 45. As will be seen, air from outside enters the conduit 45 only when the crankcase 25 is dropping below atmospheric pressure, due to the piston 20 moving upwardly from its FIG. 3 position to its FIG. 2 position. Air then flows from the conduit 45 into the conduit 36 between closure plate 35 and casing 11 and from there, by way of a semicircular port 46 (matching the semicircular partition 38) into a space 47 enclosed by a stationary filter casing 48 that is bolted to the casing 11.

Inside the stationary filter casing 48 is a rotary filter unit 50, comprising a pair of discs 51 and 52 secured together with a porous filter medium 53, such as steel wool, between them. The outer disc 51 is mounted on a sleeve 54, which is attached to the shaft 26, as by a set screw 55. The casing 48 has a rotary shaft seal 56 which engages the sleeve 54. The inner disc 52 is spaced away from the shaft 26 to provide an inner peripheral port 57 and has a flange 58 that is in rotary sealing engagement with a rotary shaft seal 59 mounted in the closure plate 35. The outer periphery 60 of the filter unit 50 is open and is spaced somewhat in from the inner periphery 61 of the casing 48 to provide for air passage to one or more conduits 62 leading to conduits 37 and thereby into the crankcase 25. Crankcase volume is kept small, by so casting the casing 11 to reduce volume, to compensate for the volume inside the filter casing 48, so that the piston 20 varies the pressure in the crankcase 25 adequately below and above atmospheric.

The air from the conduit 36 thus flows via the port 46 into the port 57 at the inner periphery of the filter 50, then outward through the filter medium 53, leaves the outer periphery 60, and then flows via the conduits 62 and 37 into the crankcase 25.

The oil reservoir 65

An oil reservoir 65 (See FIGS. 3–5) is conveniently located beneath the crankcase 25, though partitioned off from it. The reservoir 65 is placed under pressure by means of a conduit 66 having a check valve 67 and leading via a passage 68 into an air space 69 at the upper end of the reservoir 65, from a drainage cup 70 formed by a part of the filter casing 48. The check valve 67 is preferably of a magnetic type to ensure quick action. Oil which collects at the bottom of the crankcase 25 flows via a sump 71 and a conduit 72 into the drainage cup 70, and then into the conduit 66. Oil which is filtered out from the air, flows from the drainage cup 70 into the conduit 66. Both the sump 71 and the drainage cup 70 are at crankcase pressure. The check valve 67 prevents backflow from the reservoir 65 to the crankcase 25; so air that enters at more than atmospheric pressure, thereby pressurizing the reservoir 65 relative to the crankcase 25 and holding the pressure in the reservoir 65 when the crankcase pressure begins dropping below atmospheric.

As can be seen by FIGS. 3, 4, 5, and 8, oil is fed from a low level of the reservoir 65 through an opening 73 into the interior of a sleeve 74 whence it can enter an opening 75 in a tube 76. A branch conduit 68*a* for air under pressure leads from the passage 68 into the upper end of the sleeve 74. The tube 76 has a check valve 77, and oil flows upwardly through a needle valve 78, from which it is injected via a conduit 79 into the conduit 37 through which the air stream enters the crankcase 25.

Air flow in and out of the crankcase 25 and concomitant oil flow

As stated, air flow is generated, and its direction determined by, the movement of the piston 20 in the cylinder 12, which determines the crankcase pressure. When the piston 20 is moving upwardly (from its FIG. 3 position to its FIG. 2 position) air is drawn into the crankcase 25, and when the piston 20 is moving down from its FIG. 2 position to its FIG. 3 position, air is being expelled from the crankcase 25. At the time when air is being drawn into the crankcase 25, the air pressure in the reservoir 65, being higher than the pressure in the crankcase 25, forces some oil through the needle valve 78 and into the air stream. The air therefore carries this oil as a mist throughout the entire interior of the crankcase 25 and lubricates all the bearings. The mist is also carried into the lower portion of the cylinder 12. The air-oil mist is not permitted to flow into the combustion chamber 80 of the engine 10 nor into the ports 15 or 16.

Air flow from the crankcase 25 to the intake manifold 17

Downward movement of the piston 20 forces a predetermined amount of air-oil mist to flow out from the crankcase 25 through the ports 37 and 62 and to the outer periphery 60 of the filter 50. The air flows through the filter 50, and in doing so the air is centrifugally freed from oil, aided by the filter medium 53. The filtered oil passes back into the reservoir 65 through the conduit 66, and oil from the oil sump 71 at the bottom of the crankcase 25 collects by condensation and gravitation and is drained into the conduit 66 via the drainage cup 70 and conduit 72. The air is freed from oil as it flows through the separator or filter 50 and passes out from the inner periphery 57, whence it flows via the port 46 and conduit 36 back to the conduit 45.

The air, after leaving the crankcase 25 and passing through the filter 50, is oil-free and is ready to be mixed with fuel for use in the combustion chamber 80 of the engine 10. Since the air contains no oil, no oil is consumed in the combustion chamber 80 of the engine 10. The air passes from the conduit 45 to a conduit portion 81 leading to a venturi 82 and from the venturi 82 flows to the intake manifold 17 and from there, through the intake ports 16 and into the cylinder 12.

Fuel flow

Fuel comes into the engine 10 from a tank 83 (FIG. 1) via a fuel line 84 having therein a check valve 85. The fuel flows into a bowl 86, which may be a carburetor bowl with a float valve, although no carburetion is truly performed in the assembly 87 which includes this bowl. From the bowl 86, a fuel supply line 88 having a check valve 89 leads the fuel through a metering valve 90, which may be a needle valve, into the venturi 82. There it is drawn into the air, due to the low pressure created by the venturi 82 after exhaust has taken place and the intake ports 16 are open. Mixture is accomplished in the expansion portion of the venturi 82 at the entrance to the intake manifold 17. Thus carburetion is performed in a different manner from the usual method, taking place after the air has left the crankcase 25 and within the venturi 82, which is part of the intake manifold 17 and is separated from the assembly 87. No oil, it must be stressed, is introduced into the fuel, nor is any present in the fuel-air mixture.

Fuel enrichment is obtained without the use of a choke by means of placing air under crankcase pressure into a subordinate conduit 91 connected to and midway between the conduit 45 and the conduit 81. A valve 92 has two positions. In the normal position, the valve 92 admits air from the atmosphere via a conduit 93 into a conduit 94 that conducts it into the assembly 87, where it assures that the bowl 86 is under atmospheric pressure. In other words, the space 95 above the fuel in the bowl 86 is normally under atmospheric pressure. However, when fuel enrichment is desired, the valve 92 is moved to close off the conduit 93 and open the conduit 94 to the conduit 91. In this position, air under crankcase pressure is conducted from midway between the conduit 45 and the conduit 81 into the space 95 over the surface of the fuel in the bowl 86. This air more highly pressurizes the fuel in the bowl 86, which is normally held under atmospheric pressure. During this fuel enrichment operation, the fuel in the bowl 86 is thus subjected to additional pressure. The additional pressure causes more fuel to pass through the needle valve 90 and to enter the venturi 82. Operation of the fuel enrichment system is done in the normal manner, with what appears like a choke lever 96 operating the valve 92.

Some comments on the rotary filter 50

The rotary filter 50 is one of the key components of the engine 10. Without it, the engine 10 would consume oil. The rotary filter 50 is a spinning wheel with filtering media 53 through which the air can pass from outside the engine 10 into the crankcase 25, and then from the crankcase 25 to the intake manifold 17. The sole purpose of the rotary filter 50 is to remove oil from the air when the air passes from the crankcase 25 toward the venturi 82, at the times when the piston 20 is moving from its FIG. 2 position to its FIG. 3 position. The filtering is accomplished primarily by centrifuging, that is, by centrifugal force, and partly by the filtering medium 53. As noted before, when air is introduced into the crankcase 25 from the outside atmosphere, it enters the rotary filter 50 at the inner periphery 57, near the shaft 26, i.e., at the center or hub of the spinning wheel 50. The rotary filter 50 is traveling at the same r.p.m. as the engine crankshaft 26, and this is a high rate of speed. The air flowing toward the crankcase 25 thus passes from near the center of the spinning wheel 50 outwardly to the outer periphery 60 and thence into the crankcase 25.

When the piston 20 is moving downwardly, it begins to compress air within the crankcase 25. The air then leaves the crankcase 25, taking the same path back from which it came. The difference is that this time the air is going from the outer periphery 60 of the spinning wheel 50 toward the center of the spinning wheel 50. The air, with the slight oil mist in it, must pass through the rotary filter 50 in order to get to the intake manifold 17 and the venturi 82. As it does this, oil accumulates on the filter medium 53 and is immediately cast out by centrifugal force. The cubic inch displacement of the piston 20 does not have the capacity to force the *oil* inwardly against the centrifugal force, but air can pass inwardly through the rotary filter 50, for air can be compressed while the liquid oil cannot. As a result, oil inevitably collects on the filtering medium 53 of the spinning wheel 50, and the high centrifugal force of the spinning wheel 50 does not allow any liquid, in this case oil, to pass through it inwardly, but at the same time it does not restrict the air flow. The rotary filter 50 is used as a cleaning or isolating part of the engine 10 to isolate the oil reservoir 65 and the crankcase 25 from the intake manifold 17, so far as the lubrication system is concerned. It, however, does let the air pass through, and it assures that the air entering the venturi 82 is substantially free from oil.

The volume of the rotary filter 50 can be changed to meet the oiling needs of a specific engine. The cubic inch capacity of the rotary filter may be less, equal to, or greater than, the cubic inch capacity of the piston 20. The crankcase volume is, as said, kept small.

It is important to remember that just as much air passes through the filtering medium 53 from the center out as passes from the perimeter toward the center. In other words, just as much air tries to cleanse the filtering medium 53 of oil while entering, as there is air trying to put oil into the filtering medium 53 when air is flowing out of the crankcase 25. As a result, there is a canceling effect, except as affected by gravitation, oil creepage, and so on.

If the air entering into the crankcase 25 be considered a positive factor, being clean air, and the air that has the oil mist blended with it leaving the crankcase 25, be considered as a negative factor, then since they are equal in amount, they substantially cancel each other out. The spinning wheel 50 makes certain that they do cancel each other out. The clean air entering the spinning wheel 50 from the center of the hub and moving outward and the oily air entering at the periphery 60 and working inward, are moving in opposite directions and doing so at different times. The spinning wheel 50 removes the oil from the air charge that is forced toward the venturi 82.

A novel effect of the rotary filter 50 is its blower effect. Like any other spinning object that enables air to flow from the center outward, it tends to act as a blower, which in no way affects the performance of the engine 10, due to the equilibrium factor discussed earlier. The blower effect is always into the crankcase 25. Centrifugal force is the only force that is always present and uncanceled, always moving the liquid out and away from the center to the outer periphery 60. In effect, the rotary filter 50 is a two-way port between the engine crankcase 25 and the intake manifold 17, and it keeps the oil mist on one side and the clean air on the other.

Lubrication within the crankcase 25

As the air enters the engine crankcase 25 on the crankcase side of the rotary filter 50, it passes through the openings 62 and 37. As the piston 20 moves up and draws a fresh charge of air into the crankcase 25, the air passes through these ports 62 and 37, and as it does so, minute droplets of oil are formed on the end of the oil line 79 leading from the oil reservoir 65. The air passes very quickly through the portals 62, 37 and blends with the oil to form a slight mist of light density. This air-oil mist moves throughout the crankcase 25 and lubricates the moving parts within the crankcase 25.

Then, as the piston 20 begins its downward stroke, the air-oil mist is forced into the rotary filter 50, where the oil is cast-off, collecting on the walls of the stationary filter casing 48. Gravitation then moves the oil to the drainage cup 70 at the bottom of the casing 48. Oil that condenses and drops down in the crankcase 25 collects in the sump 71 and flows by gravitation to the drainage cup 70 via a conduit 72.

The entire oiling system is operated by air pressure changes. As the oil collects in the drainage cup 70, it is returned to the oil reservoir 65 by an air stream sending it through the conduit 66. The entire oiling system, including the engine crankcase 25 and the oil reservoir 65 is isolated from the rest of the engine 10 by the rotary filter 50 and is, in basic effect, a closed system. Thus, when the piston 20 begins its downward stroke, the oil reservoir 65 and the interior of the sleeve 74 are pressurized with the same pressure that exists throughout the crankcase 25. When the piston 20 begins its upward travel, the crankcase 25 then becomes a low pressure area, but the high pressure remains trapped in the oil reservoir 65 due to the check valve 67. The high pressure in the oil reservoir 65 forces oil through the oil line 79, going past the check valve 77 and through the oil metering needle valve 78. The high pressure then moves the oil into the incoming air stream. As long as the oil reservoir 65 air pressure is high and the crankcase 25 pressure low, that is, when the piston 20 is traveling upwardly, the oil continues to move toward the low pressure area.

It is important to note that the oil is metered precisely by the needle valve 78, the setting of which can be changed, if desired. The action of feeding oil out through the conduit 79, bleeds off some of the pressure from the oil reservoir 65 into the crankcase 25, but when the piston 20 begins its next downward stroke, it again creates a high pressure in the crankcase 25. The crankcase pressure is then higher than the pressure in the oil reservoir 65. The oil reservoir 65 has been isolated from the crankcase 25 by the one-directional check valve 67 in the oil return line 66. While oil is being spun off the rotary filter 50 and collected in the drainage cup 70, the high pressure of the descending piston 20 has created a higher pressure in the crankcase 25 than in the oil reservoir 65, so that the oil accumulated in the drainage cup 70 is moved past the check valve 67 and back to the oil reservoir 65. If there is no oil in the drainage cup 70, the air from the high pressure within the crankcase 25 merely increases the pressure in the oil reservoir 65. Any oil that is collected in the line 66 is moved along with the air pressure.

Thus, the entire isolated oiling system works by pressure changes in the oil reservoir 65 and in the engine crankcase 25. To summarize, when the crankcase pressure is high, oil is returned to the reservoir 65, and when the crankcase pressure is low, a metered amount of oil is sent into the incoming air stream. Reservoir pressure is high only when the piston 20 is moving upward. It is also important to note that the density of the oil mist is very light, just enough to create an oil film over the moving parts within the crankcase 25. This includes the piston 20 and cylinder 12, and it also includes the bearings for the shaft 26, the bearings for the wrist pin and the bearings 33 for the connecting rod 32.

Some oil is cast-off the engine's moving parts and is not moved toward the rotary filter 50 by the airstream. Such oil collects, by means of gravitation, in the sump 71, at the bottom of the engine's crankcase 25, which drains down to the drainage cup 70 at the bottom of the rotary filter casing 48. The drainage cup 70 is the lowest point of any gravitation-returned oil, and once oil is in the drainage cup 70 air pressure moves this oil, along with the oil cast-off from the rotary filter 50, back to the oil reservoir 65. The cycle continues as long as the varying air pressures between the crankcase 25 and the oil reservoir 65 continue, and this continues as long as the engine 10 runs.

As mentioned before, it is important for the isolated oiling system, that there be a sufficient number of operative piston rings 21, 22, 23, 24, and the piston rings 23, 24 at the bottom of the piston 20 prevent the oil from creeping up the cylinder wall 12 and into the exhaust and intake ports 15 and 16. These rings 21, 22, 23, 24 are wiping and compression rings that keep the cylinder 12 clean and prevent oil consumption. Rings 23 and 24 never expose the intake or exhaust ports 15 and 16 to crankcase oil mist. Since the upper rings 21, 22 always travel further down the cylinder wall 12 than the highest upward travel of the lower rings 23, 24 adequate lubrication is given to them.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

I claim:

1. A two-stroke piston engine of the type having a cylinder having a head, an open end, intake port means, and exhaust port means generally closer to said head than said intake port means, a piston having oil-sealing and compression rings near each end, a crankcase adjacent to and opening into the open end of said cylinder, and a rotatable shaft bearinged in and extending outside said crankcase having a crank joined to said piston by a connecting rod bearinged to said crank and to said piston, an intake manifold connected to and encasing said intake port means, and a fuel system having a fuel intake line, a bowl normally under atmospheric pressure, and a fuel supply line leading from said bowl to said intake manifold, said engine having, in combination therewith:

air inlet means having a throttle plate and check valve means for admitting air from the atmosphere when the atmospheric pressure is greater than the pressure on the other side of the check valve means, first air conduit means connecting said air inlet means to said crankcase and for admitting air to said crankcase when the pressure inside the crankcase is below atmospheric pressure, as a result of said piston moving toward said head, an oil reservoir separated from said crankcase, oil metering means for metering oil from said reservoir into said air conduit means as said piston moves toward said head, so that the metered oil is mixed with air and carried thereby into said crankcase and into the open end of said cylinder, to lubricate bearings and piston rings therein, said crank having a throw greater than the distance between said oil-sealing and compression rings, the piston rings most distant from said head never moving past said intake port means or said exhaust port means, said air and oil being forced out from the crankcase into said first air conduit means as said piston moves away from said head, the pressure in said crankcase then operating to close said check valve means, a rotary centrifuging filter in said first air conduit means for separating oil out from the air that leaves the crankcase, said filter having an inner periphery and an outer periphery and having inlet and outlet means at said peripheries such that air flowing from said first air conduit means into said crankcase enters said filter at said inner periphery, and leaves said filter at said outer periphery whence it passes to said oil metering means and from there into said crankcase, while air flowing from said crankcase back into said first air conduit means enters said filter at said outer periphery and leaves it at said inner periphery, the oil then being flung from said outer periphery, oil return means for returning the oil from said separating means and from the bottom of said crankcase to said reservoir while leaving the air from the crankcase oil-free, and second air conduit means for sending the oil-free air to said intake manifold via a venturi at the entrance to said intake manifold, there to draw in and mix with said fuel from said fuel supply line, which is connected to said venturi via a metering device, so that a mixtre of fuel and oil-free air passes to said intake port means at the time the piston opens said intake port means.

2. A two-stroke piston engine of the type having a cylinder having a head, an open end, intake port means, and exhaust port means generally closer to said head than said intake port means, a piston having oil-sealing and compression rings near each end, a crankcase adjacent to and opening into the open end of said cylinder, and a rotatable shaft bearinged in and extending outside said crankcase having a crank joined to said piston by a connecting rod bearinged to said crank and to said piston, an intake manifold connected to and encasing said intake port means, and a fuel system having a fuel intake line, a bowl normally under atmospheric pressure, and a fuel supply line leading from said bowl to said intake manifold, said engine having, in combination therewith:

air inlet means having a throttle plate and check valve means for admitting air from the atmosphere when the atmospheric pressure is greater than the pressure on the other side of the check valve means, first air conduit means connecting said air inlet means to said crankcase and for admitting air to said crankcase when the pressure inside the crankcase is below atmospheric pressure, as a result of said piston moving toward said head, an oil reservoir separated from said crankcase, oil metering means for metering oil from said reservoir into said air conduit means as said piston moves toward said head, so that the metered oil is mixed with air and carried thereby into said crankcase and into the open end of said cylinder, to lubricate bearings and piston rings therein, said crank having a throw greater than the distance between said oil-sealing and compression rings, the piston rings most distant from said head never moving past said intake port means or said exhaust port means, said air and oil being forced out from the crankcase into said first air conduit means as said piston moves away from said head, the pressure in said crankcase then operating to close said check valve means, separating means in said first air conduit means for separating oil out from the air that leaves the crankcase, oil return means for returning the oil from said separating means and from the bottom of said crankcase to said reservoir while leaving the air from the crankcase oil-free, and second air conduit means for sending the oil-free air to said intake manifold via a venturi at the entrance to said intake manifold, there to draw in and mix with said fuel from said fuel supply line, which is connected to said venturi via a metering device, so that a mixture of fuel and oil-free air passes to said intake port means at the time the piston opens said intake port means, said separating means comprising a rotary centrifuge-filter mounted on said shaft and rotating with it and containing a filter medium aiding in separating oil from air, said filter having an inlet for the air-oil mist leaving said crankcase at its outer periphery and an outlet for oil-free air at an inner periphery adjacent said shaft, air entering said crankcase from said first conduit means passing through said filter from the inner periphery to the outer periphery.

3. A two-stroke piston engine of the type having a cylinder have a head, an open end, intake port means, and exhaust port means generally closer to said head than said intake port means, a piston having oil-sealing and compression rings near each end, a crankcase adjacent to and opening into the open end of said cylinder, and a rotatable shaft bearinged in and extending outside said crankcase having a crank joined to said piston by a connecting rod bearinged to said crank and to said piston, an intake manifold connected to and encasing said intake port means, and a fuel system having a fuel intake line, a bowl normally under atmospheric pressure, and a fuel supply line leading from said bowl to said intake manifold, said engine having, in combination therewith:

air inlet means having a throttle plate and check valve means for admitting air from the atmosphere when the atmospheric pressure is greater than the pressure on the other side of the check valve means, first air conduit means connecting said air inlet means to said crankcase and for admitting air to said crankcase when the pressure inside the crankcase is below atmospheric pressure, as a result of said piston moving toward said head, an oil reservoir separated from said crankcase, oil metering means for metering oil from said reservoir into said air conduit means as said piston moves toward said head, so that the metered oil is mixed with air and carried thereby into said crankcase and into the open end of said cylinder, to lubricate bearings and piston rings therein, said crank having a throw greater than the distance between said oil-sealing and compression rings, the piston rings most distant from said head never moving past said intake port means or said exhaust port means, said air and oil being forced out from the crankcase into said first air conduit means as said piston moves away from said head, the pressure in said crankcase then operating to close said check valve means, separating means in said first air conduit means for separating oil out from the air that leaves the crankcase, oil return means for returning the oil from said separating means and from the bottom of said crankcase to said reservoir while leaving the air from the crankcase oil-free, second air conduit means for sending the oil-free air to said intake manifold via a venturi at the entrance to said intake manifold, there to draw in and mix with said fuel from said fuel supply line, which is connected to said venturi via a metering device, so that a mixture of fuel and oil-free air passes to said intake port means at the time the piston opens said intake port means, and a fuel enrichment system accomplishing what is, in other engines, accomplished by a choke, comprising a check valve in said fuel intake line, an air conduit leading from said second air conduit means at a point before said venturi and leading into an air space above and inside said bowl, and a valve normally closing off said air conduit and normally admitting air from the atmosphere into said air space, and actuating means for openin said normally closed valve and closing off air from atmosphere, to place air under crankcase pressure in said second air conduit in the air space above said bowl, thereby to force more fuel through said fuel supply line to said venturi to enrich the fuel-air mixture fed to said intake port means.

4. A two-stroke piston engine including in combination:

a cylinder having a head, an open end, intake ports, and exhaust ports generally closer to said head than said intake ports, a piston in said cylinder and having oil-sealing and compression rings near each end, an enclosed crankcase of limited volume adjacent to and opening into said open end of said cylinder, a rotatable shaft bearinged in and extending outside of said crankcase, having a crank in said crankcase, a connecting rod joining said piston to said crank at bearings, said crank having a throw greater than the distance between said oil-sealing and compression rings, the piston ring most distant from said head never moving past said intake or exhaust ports, an intake manifold connected to and enclosing said intake ports and having a venturi at its entrance, a fuel system having a fuel intake line, a bowl normally under atmospheric pressure, and a fuel supply line having a check valve therein leading from said bowl to said venturi, an air inlet having a throttle plate and a reed check valve, a first air conduit system connecting said air inlet to said crankcase, an oil reservoir separated from said crankcase, oil metering means for metering oil from said reservoir into said first air conduit system as said piston moves toward said head, so that metered oil at metered flow is mixed with the air and carried as an air-oil mist into said crankcase to lubricate the bearings therein and into the open end of said cylinder to lubricate rings there, said air and oil being forced out from the crankcase and back through said first air conduit system as said piston moves away from said head, the pressure in said crankcase then operating to close said reed check valve, separator means in said first air conduit system for separating the air that has left the crankcase from the oil therein, oil return means for returning the separated oil from said separator means and from the bottom of said crankcase to said reservoir while leaving the separted air oil-free, a second air conduit system for sending the oil-free air to and through said venturi, there to draw in and mix with said fuel from said fuel supply line, so that a mixture of oil-free fuel and oil-free air passes to said intake ports at the time the piston opens said intake ports, and a fuel enrichment system accomplishing what is, in other engines, accomplished by a choke, comprising a check valve in said fuel intake line, a first air conduit leading from said second air conduit system at a point before said venturi, a second air conduit leading from atmosphere, a third air conduit leading into the air space above said bowl, and a valve joining said third air conduit to said first conduit in a first position and to said second conduit in a second position, and means for operating said valve for normal conditions to place air under atmospheric pressure in the space above said bowl and under fuel enrichment conditions to close off atmosphere one and place the space above the fuel in said bowl at the pressure in said second conduit system and thereby to force more fuel through said fuel supply line to said venturi, to enrich the fuel-air mixture fed to said intake ports.

5. A two-stroke piston engine including in combination:

a cylinder having a head, an open end, intake ports, and exhaust ports generally closer to said head than said intake ports, a piston in said cylinder and having oil-sealing and compression rings near each end, an enclosed crankcase of limited volume adjacent to and opening into said open end of said cylinder, a rotatable shaft bearinged in and extending outside of said crankcase, having a crank in said crankcase, a connecting rod joining said piston to said crank at bearings, said crank having a throw greater than the distance between said oil-sealing and compression rings, the piston ring most distant from said head never moving past said intake or exhaust ports, an intake manifold connected to and enclosing said intake ports and having a venturi at its entrance, a fuel system having a fuel intake line, a bowl normally under atmospheric pressure, and a fuel supply line having a check valve therein leading from said bowl to said venturi, an air inlet having a throttle plate and a reed check valve, a first air conduit system connecting said air inlet to said crankcase, an oil reservoir separated from said crankcase, oil metering means for metering oil from said reservoir into said first air conduit system as said piston moves toward said head, so that metered oil at metered flow is mixed with the air and carried as an air-oil mist into said crankcase to lubricate the bearings therein and into the open end of said cylinder to lubricate rings there, said air and oil being forced out from the crankcase and back through said first air conduit system as said piston moves away from said head, the pressure in said crankcase then operating to close said reed check valve.

separator means in said first air conduit system for separating the air that has left the crankcase from the oil therein, said separator means comprisinga rotary centrifuge-filter mounted on said shaft and containing a filter medium aiding in separating oil from air, said centrifuge-filter having an inlet for air entering said crankcase at an inner periphery adjacent the shaft with an outlet into said crankcase at its outer periphery and having the air-oil mist enter the centrifuge-filter from the crankcase at said outer periphery, with oil-free air leaving at the inner periphery, so that the air flows through said centrifuge-filter both when entering and leaving said crankcase and in opposite directions, oil return means for returning the separated oil from said separator means and from the bottom of said crankcase to said reservoir while leaving the separated air oil-free, a second air conduit system for sending the oil-free air to and through said venturi, there to draw in and mix with said fuel from said fuel supply line, so that a mixture of oil-free fuel and oil-free air passes to said intake ports at the time the piston opens said intake ports.

6. The two-stroke piston engine of claim 5 wherein said centrifuge-filter comprises a pair of spaced-apart imperforate discs, joined together, one disc having a sleeve secured to said shaft, the other disc having a flange spaced from said shaft and providing the inner peripheral entrance-outlet, and fibrous material between the discs.

7. The two-stroke piston engine of claim 6 wherein there is a stationary filter casing around and spaced from said disc and a first rotary oil seal mounted in said casing sealing between said casing and said sleeve, and a second rotary oil seal mounted on the engine crankcase sealing with said flange.

8. The two-stroke piston engine of claim 7 wherein at the bottom of said filter casing is an oil drainage cup connected to said oil-return means and also to a sump at the bottom of said crankcase.

9. A method for operating a two-stroke piston engine comprising the steps of:

admitting air from the atmosphere to the crankcase only when the crankcase pressure is below atmospheric and then flowing it through a rotating centrifuge-filter from the inner periphery thereof to the outer periphery thereof, adding oil into the air entering said crankcase from said filter to provide a lubricating air-oil mist, expelling air-oil mist from the crankcase when the pressure in the crankcase increases to above atmospheric, separating the oil from the air leaving the crankcase so that the air is rendered oil free, by flowing the expelled air-oil mist into said centrifuge-filter from its outer periphery, flinging oil from said outer periphery and the oil-free air leaving from said inner periphery, conducting the oil-free air from the separating step, mixing fuel with the oil-free air, sending the air-fuel mixture to the engine's combustion chamber, and recovering the oil from said centrifuge-filter for recirculation to said adding step.

10. The method of claim 9 wherein the mixing of the fuel with the air is done by increasing the velocity of said oil-free air momentarily by restricting the area of its passage and then enlarging the passage area to enable its expansion, and feeding fuel at a metered flow to said air at the place where said area is at enlarged expansion.

11. A method for operating a two-stroke piston engine having a piston, a cylinder with a head and an intake manifold, a crankcase of restricted volume, and an enclosed crankshaft connected to the piston by a connecting rod, the cylinder having a combustion chamber with intake and exhausting ports, the engine also having a fuel tank connected by a fuel line to a fuel bowl normally at atmospheric pressure, said fuel line having a check valve, comprising the steps of:

admitting air from the atmosphere only when the crankcase pressure is below atmospheric, as a result of the piston movement toward said head, conducting the admitted air into said crankcase while the pressure in said crankcase is below atmospheric, adding oil into the air entering said crankcase to provide a lubricating air-oil mist, expelling air-oil mist from the crankcase when the pressure in the crankcase increases to above atmospheric, as a result of the piston moving away from the head, separating the oil from the air leaving the crankcase, so that the air is rendered oil-free, conducting oil-free air from said separating step, increasing the velocity of said oil-free air momentarily by restricting the area of its passage and then enlarging the passage area to enable its expansion, at a venturi near the entrance to said intake manifold, feeding fuel at a metered flow from said bowl to said air where the air is expanding to provide an oil-free fuel-air mixture, conducting said fuel-air mixture into said combustion chamber through said intake ports, and enriching the fuel-air ratio when enrichment is needed by, passing some of said oil-free air from a point ahead of said venturi to said fuel bowl to pressurize said fuel bowl at crankcase pressure instead of atmospheric pressure to force more fuel to said venturi than would be done at atmospheric pressure.

12. A two-stroke piston engine having a piston, a cylinder, and a crankcase of restricted volume, with a crankshaft connected to the piston by a connecting rod, the cylinder having intake ports with an intake manifold leading thereto and exhaust ports, the engine also having a fuel tank connected by a fuel line to a fuel bowl at atmospheric pressure, and in combination therewith, air intake means for admitting air from the atmosphere into said engine only when the crankcase pressure is below atmospheric, first conduit means for conducting air from said air intake mekans into said crankcase when the pressure in said crankcase is below atmospheric and for conducting air out from the crankcase when the pressure in said crankcase is above atmospheric, said air intake means having pressure-responsive means for closing said air intake means when the pressure in said first conduit means is above atmospheric, oiling means at the place where said first conduit means enters the crankcase, for sending oil into the air entering said crankcase, when said crankcase is below atmospheric, for lubricating, by an air-oil mist, the parts therein requiring lubrication, second conduit means connecting said first conduit means to said intake manifold and transmitting air from said crankcase to said intake manifold when the crankcase pressure is above atmospheric, said second conduit means including a venturi at the entrance to said intake manifold, a rotary centrifuging filter wheel in said first conduit means between said air intake means and said oiling means, mounted on said crankshaft outside said crankcase and containing a freely air-permeable filter medium aiding in separating oil from air, said filter having an outer port at its outer periphery and an inner port adjacent the shaft, said first conduit means causing the air flowing to said crankcase from said air intake means to enter said filter wheel at said inner port and to flow into said crankshaft via said outer port, while causing the air and oil leaving said crankshaft to enter said outer port, the oil being separated from the air with air only leaving said inner port en route to said second conduit means;

said filter wheel having oil collection means adjacent said outer periphery, and fuel feeding means for conducting fuel at a metered rate from said bowl to said venturi, whereby said engine is properly lubricated without incorporating lubricant into said fuel and while recycling the oil used as lubricant.

* * * * *

UNITED STATES PATENT AND TRADEMARK OFFICE

CERTIFICATE OF CORRECTION

PATENT NO. : 4,142,487

DATED : March 6, 1979

INVENTOR(S) : Tomas P. Somraty

It is certified that error appears in the above-identified patent and that said Letters Patent are hereby corrected as shown below:

First page, left-hand column, item [76], the address of the inventor, printed as "111 Cleeland Rd." should read --111 Cleveland Rd.--; item [56], under "U.S. PATENT DOCUMENTS" names of the inventors, "Ellu" should read --Ellis--; "Hager" should read --Hagar--; "Peter" should read --Petter-- and "Gerhandt" should read --Gernandt--.

Column 2, line 47, "reservir" should read --reservoir--.

Column 4, line 43, "until the air" should read --until after the air--.

Column 13, line 2, "have" should read --having--.

Column 13, line 65, "openin" should read --opening--.

Column 15, line 51, "comprisinga" should read --comprising a--.

Column 17, line 38, "mekans" should read --means--.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*